US008137811B2

(12) United States Patent
Merchant et al.

(10) Patent No.: US 8,137,811 B2
(45) **Date of Patent: *Mar. 20, 2012**

(54) MULTICOMPONENT TAGGANT FIBERS AND METHOD

(75) Inventors: Timothy P. Merchant, Summerfield, NC (US); Jeffrey S. Dugan, Erwin, TN (US)

(73) Assignees: Intellectual Product Protection, LLC, Summerfield, NC (US); Fiber Innovation Technology, Inc., Johnson City, TN (US)

( * ) Notice: Subject to any disclaimer, the term of this patent is extended or adjusted under 35 U.S.C. 154(b) by 753 days.

This patent is subject to a terminal disclaimer.

(21) Appl. No.: 12/205,993

(22) Filed: Sep. 8, 2008

(65) Prior Publication Data

US 2010/0063208 A1 Mar. 11, 2010

(51) Int. Cl.
*D02G 3/00* (2006.01)

(52) U.S. Cl. ..... 428/373; 428/370; 428/374

(58) Field of Classification Search ..... 428/370, 428/373, 374

See application file for complete search history.

(56) References Cited

U.S. PATENT DOCUMENTS

| | | | | |
|---|---|---|---|---|
| 4,640,035 | A * | 2/1987 | Kind et al. | 40/625 |
| 4,999,243 | A * | 3/1991 | Maeda | 428/372 |
| 5,057,368 | A | 10/1991 | Largman et al. | 428/397 |
| 5,069,970 | A | 12/1991 | Largman et al. | 428/373 |
| 5,108,820 | A | 4/1992 | Kaneko et al. | 428/198 |
| 5,277,976 | A | 1/1994 | Hogle et al. | 428/397 |
| 5,336,552 | A | 8/1994 | Strack et al. | 428/224 |
| 5,382,400 | A | 1/1995 | Pike et al. | 264/168 |
| 5,780,370 | A * | 7/1998 | Chen et al. | 442/414 |
| 6,165,609 | A * | 12/2000 | Curatolo | 428/343 |
| 6,431,715 | B2 * | 8/2002 | Scrivens | 359/883 |
| 6,832,783 | B2 | 12/2004 | Lawandy | 283/85 |
| 6,951,687 | B2 | 10/2005 | Nightingale et al. | 428/397 |
| 7,122,248 | B2 | 10/2006 | Tam et al. | 428/397 |
| 7,163,744 | B2 | 1/2007 | Nightingale et al. | 428/397 |
| 7,256,398 | B2 | 8/2007 | Ross et al. | 250/302 |
| 7,338,877 | B1 * | 3/2008 | Meyer et al. | 438/372 |
| 7,357,986 | B2 | 4/2008 | Tam et al. | 428/397 |
| 2005/0178841 | A1 | 8/2005 | Jones, II et al. | 235/468 |
| 2005/0227068 | A1 * | 10/2005 | Dugan | 428/364 |
| 2005/0277710 | A1 * | 12/2005 | Joyce et al. | 523/210 |
| 2010/0062251 | A1 * | 3/2010 | Merchant et al. | 428/374 |
| 2010/0063708 | A1 * | 3/2010 | Dotzer et al. | 701/102 |
| 2011/0111225 | A1 * | 5/2011 | Gabriele et al. | 428/373 |

OTHER PUBLICATIONS

Two page printout from the website of Hills, Inc. showing various cross section fibers and logo fibers, Feb. 23, 1995.

* cited by examiner

*Primary Examiner* — N. Edwards

(57) ABSTRACT

Taggant fibers and methods of use provide for enhanced protection and security when the fibers are used in documents such as land titles, currency, passports and other documents of value. The taggant fibers consist of a minimum of two separate zones with each zone containing a different taggant to emit different wave lengths when excited. The taggants may consist of organic or inorganic compounds as are conventionally known and can be manufactured using for example polymeric materials which can be extruded during the fiber manufacturing process. Authentication of the fibers or documents containing such fibers can be readily viewed using conventional techniques.

24 Claims, 2 Drawing Sheets

MULTICOMPONENT TAGGANT FIBERS AND METHOD

FIELD OF THE INVENTION

The invention herein pertains to fibers which contain a taggant and particularly pertains to multicomponent taggant fibers and methods of producing the same.

DESCRIPTION OF THE PRIOR ART AND OBJECTIVES OF THE INVENTION

The need for secure documents, cards, licenses and the like has increased dramatically in recent years due to the expansion of international commerce through the global information network. Banks and other financial institutes are constantly seeking ways to protect and authenticate documents which are often used in fraudulent schemes to acquire property, identities, credit and money. It is well known to incorporate optically active taggants into various documents which luminesce, fluoresce or emit various energy wave lengths that can be easily identified. These emissions may be in the visible or invisible light range.

It is also known to produce fibers and yarns containing two or more types of colorants, such as pigments and dyes, or UV-brighteners, but these active materials exhibit visible responses in the excitation frequencies of each other, e.g., pigments reflect color (though muted) in UV light, etc. It is also known to produce taggant fibers with optically active additives that visibly respond to a single stimulating illumination source.

Certain security markers or taggants are described in U.S. Pat. No. 7,256,398 and U.S. Patent Publication No. 2005/0178841. U.S. Pat. No. 6,832,783 describes optically based methods and an apparatus for performing sorting, coding and authentication for use on objects including currency, negotiable instruments, passports, wills and other documents. U.S. Pat. No. 5,108,820, U.S. Pat. No. 5,336,552, and U.S. Pat. No. 5,382,400 show multicomponent fiber constructions. The multicomponent fibers may also have unconventional shapes (such as multi-lobal) as described in U.S. Pat. Nos. 5,277,976, 5,057,368 and 5,069,970.

It is also well known to produce fibers and fabrics made from different polymers as set forth in U.S. Pat. No. 5,108,820 while U.S. Pat. No. 5,069,970 demonstrates the use of various fiber shapes. It is also conventional in the taggant art to use inorganic materials such as yttrium oxide and calcium fluoride. Organic compounds which are used as taggants include materials derived from naturally occurring fluorescent minerals. Certain organic dyes which will react under a UV light source to generate an identifiable wave length.

There is an enhanced security benefit to utilize materials or taggants where existing processing methods create problems with the co-existence of incompatible taggants. However, when the incompatible materials are brought into contact with one another in typical processing or application environments, a spontaneous reaction can occur (sometimes slowly) which will eventually reduce or destroy the effectiveness of at least one of the materials for its intended function. Such contacts should be avoided in order to provide a secure product.

Certain conventional fibers containing taggants can be duplicated by sophisticated and experienced plagiarists at the expense and harm of others. Thus to improve the security and authentication of various documents and papers, the present invention was conceived and one of its objectives is to provide a taggant fiber and method of manufacture to insure safety and security for the user.

It is another objective of the present invention to provide a taggant fiber having first and second taggants, each of which emits energy at different wave lengths when excited or may be excited by the same wave length and emit energy that is at different wave lengths.

It is still another objective of the present invention to provide a taggant fiber which has a minimum of two zones, each zone including a different taggant to prevent chemical incompatibility between the taggants from reducing or destroying their effectiveness.

It is yet another objective of the present invention to provide a taggant fiber which has an outer sheath and an inner core, with each including a different taggant.

It is still a further objective of the present invention to provide a method of manufacturing taggant fibers as described above which when used in a variety of articles can be easily authenticated.

Various other objectives and advantages of the present invention will become apparent to those skilled in the art as a more detailed description is set forth below.

SUMMARY OF THE INVENTION

The aforesaid and other objectives are realized by providing a polymeric yarn or fiber composed of two zones which are aligned in parallel along the fiber length. Each zone includes a taggant having different optical activity such that the two taggants provide optically distinguishable signals in response to two separate stimuli. One taggant may be an inorganic compound while the other taggant may consist of an organic compound. The two optically active materials may be segregated in separate polymer components of a multicomponent filament to prevent or mitigate adverse chemical reactions between the two taggants. The invention may also comprise an individual fiber in which the optically active materials are co-dispersed in the fiber or segregated in separate polymer components or zones of a multicomponent fiber.

The present invention provides advantages over the prior art in that it has improved stealth and security for inclusion in articles such as bank notes or other security papers for the purpose of establishing authenticity. The addition of a second response to a second stimulus such as a light source adds to the authentication. The use of two optically active additives that are both white or invisible in ambient light further adds to the stealth of the taggant. The inclusion of two chemically incompatible active materials segregated in separate polymer components or separate filaments raises barriers to counterfeiting as the multicomponent fiber forming process is difficult to duplicate. The segregation of the two taggant materials each in separate polymer components overcomes the natural chemical incompatibility of the taggant materials conventionally used to achieve up-converting (i.e. conversion of sub-visible illumination wave lengths into the visible spectrum) and down-converting (i.e. conversion of super-visible illumination wave lengths into the visible spectrum) responses.

The preferred form of the taggant fiber consists of the core and sheath type, though various other multiple zone fibers could be manufactured with each zone containing a different taggant.

The preferred method of the invention consists of manufacturing a taggant fiber by extruding two different polymers using conventional methods for core and sheath fibers. One zone is formed using a selected conventional polymeric material incorporating a selected taggant in the sheath. A second zone is formed in the core which includes a different taggant to thereby form a polymeric taggant fiber having an inner zone and an outer zone the length of the fiber.

DETAILED DESCRIPTION OF THE PREFERRED EMBODIMENT AND OPERATION OF THE INVENTION

Figure 1:
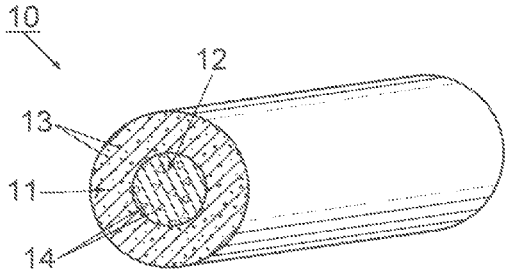
FIG. 1 shows the preferred fiber of the invention with a core zone and a sheath zone.

For a better understanding of the invention and its operation, turning now to the drawings, FIGS. 1-6 each provide a multiple component fiber containing at least a first optically active taggant which responds to a first stimulus and a different second optically active taggant which responds to a second, different stimulus wherein the two optically active taggants are segregated into separate, contiguous polymer components or fiber zones. The segregation of the two taggant materials each in separate polymer components overcomes the natural chemical incompatibility of the taggant materials. As seen in FIG. 1, preferred taggant fiber 10 demonstrates an outer sheath or zone 11 formed from a polymeric material such as polyethylene tetrathylate (PET) which includes optically active or fluorescent dye 13 and inner core or zone 12 also formed from a polymeric material such as polyethylene tetrathylate (PET) which includes a second optically active taggant 14 which is different from taggant dye 13 in first zone 11 which provides a down-converting response. Taggant 14 in inner zone 12 is preferably yttrium oxide, an inorganic compound and provides an up-converting response. Standard extrusion methods can be used to manufacture polymeric fiber 10 which can be incorporated into wills, bank notes, currency or the like by known manufacturing techniques. When it is desired to authenticate such documents, fiber 10 is subjected to two (2) different standard selected energy radiation (stimuli) causing two (2) emissions from fiber 10 which are read through conventional equipment. If the two (2) expected emissions are received then the documents or the like are presumed valid and authenticate.

Figure 2:
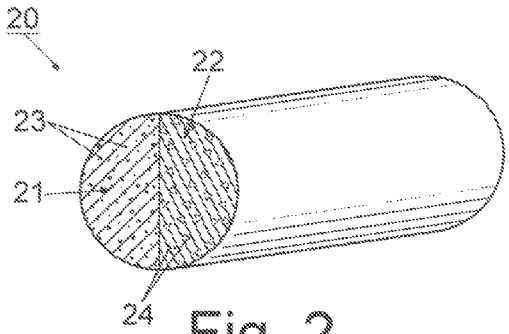
FIG. 2 illustrates an alternate taggant fiber with two contiguous zones in a side-by-side configuration.

In FIG. 2 an alternate fiber embodiment is shown with fiber 20. Taggant fiber 20 has contiguous side-by-side first zone 21 and second zone 22. First zone 21 includes first taggant 23 and second zone 22 includes a second, different taggant 24. First taggant 23 may for example be a known organic taggant whereas second, conventional taggant 24 may be a known inorganic taggant, although both zones may contain organic or inorganic taggants, provided each taggant is different.

Figure 3:
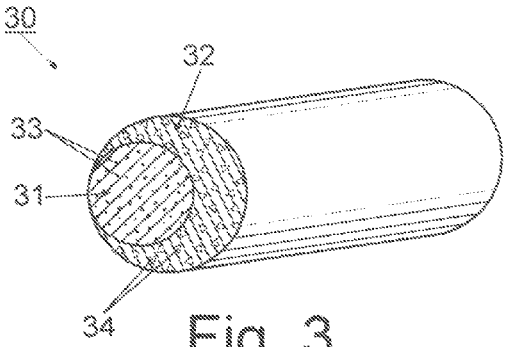
FIG. 3 demonstrates an alternate taggant fiber of the invention in a side-by-side "cam" arrangement.

In FIG. 3, another alternate fiber embodiment is shown with taggant fiber 30 having a first zone 31 formed from a first polymeric material and a second zone 32 formed from a different polymeric material. Taggants 33 and 34 as shown therein represent known taggants that react to different wave lengths when excited to emit different wave lengths for authentication purposes.

Figure 4:
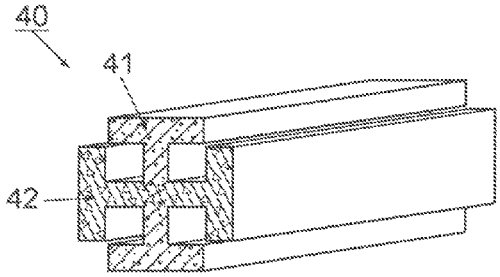
FIG. 4 features yet another embodiment of a two zone taggant fiber.
Figure 5:
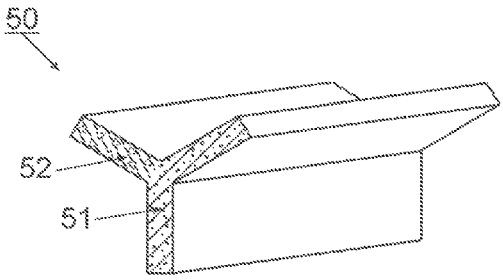
FIG. 5 depicts a multi-lobal two zone taggant fiber.
Figure 6:
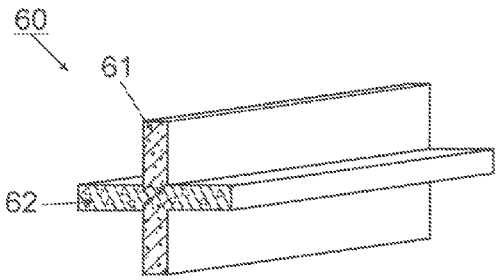
FIG. 6 pictures yet another multi-lobal two zone taggant fiber.

FIGS. 4-6 also represent different fiber shapes as alternate taggant fibers. In FIG. 4 taggant fiber 40 includes first zone 41 and a second zone 42. FIG. 5 illustrates taggant fiber 50 in a "Y" or multi-lobal configuration having first zone 51 and second zone 52. FIG. 6 illustrates taggant fiber 60 in a "+" configuration and includes first zone 61 and second zone 62. It being understood that each zone of fibers 40, 50 and 60 have different taggants for different wave length emissions when properly excited and each zone may be formed from different or identical known polymeric materials.

The preferred embodiment of the invention is a multicomponent fiber or filament with a UV-responsive (down-converting) additive or taggant in one polymer component, and an IR-laser-responsive (up-converting) taggant in a separate and different polymer component.

Various embodiments include staple fibers, yarns made from bundles of filaments or staple fibers, or both, fibers and/or filaments extruded in the spun-bond or melt-blown fabric forming processes, and articles, particularly various types of security papers, incorporating such fibers and/or filaments. For incorporation in various documents, the various embodiments described herein may be formed in different lengths, such as continuous, short (for textiles 1-6" [2.54-15.24 cm]) and very short for banknote applications.

The preferred process of the invention comprises compounding and/or bi-component fiber extruding with energy converting materials or taggants including up and down converters that function within a range from 200 nm to 1200 nm. The combination of taggants may include one or more up converters or down converters in combination with bi-component fibers. Known taggant materials include various inorganic and organic compounds of sizes ranging from sub-micron up to 10 microns. The taggants function by absorbing incident light in one portion of the spectrum (200 nm to 1200 nm) and output PEAK energy in another portion of the same spectrum within the same range (200 nm to 1200 nm).

The quantities of taggant material that can be used in making a security bi-component fiber are numerous. They include both inorganic and organic materials. These materials range from sub-micron particle size up to approximately 8 microns and come in the form of luminescent powders. An example of an inorganic material that can be used is yttrium oxide. This material is baked at approximately 300° C. and allowed to dry and slightly harden so that inclusion into the bi-component polymer is optimized. Yttrium oxide is a rare earth inorganic compound that has the unique property of being able to convert energy. When this material has IR energy (950 nm to 1100 nm) incident (excitation) upon it, the material will absorb the IR energy and convert (emit) the energy in the visible spectrum range (400 nm to 700 nm) where the unaided human eye can see the effect. Some forms of inorganic taggant material will emit green, red or blue light. Other forms may emit light into the near infrared region where the unaided human eye cannot see the emission (750 nm and longer). Both phenomena are referred to as up conversion, because the energy required to move on the spectral scale from longer wave lengths to lower wave lengths requires more energy than moving from lower wave lengths to longer wave lengths (down converting).

Fluorescent taggant materials are often inorganic materials that absorb molecular photons from longer wave lengths (excitation), (365 nm to 265 nm) and emit energy in the visible spectrum. An example of this type of taggant is calcium fluoride ($CaF_2$). When used as an inclusion, this taggant can be excited with 365 nm long wave UV light and will emit light in the visible spectrum.

Known organic taggants may include fluorescent dyes, phytochrome, riboflavin, isotopic tags or others.

The use of bi-component fibers allows both inorganic and organic taggants to be present in the same fiber. The emissions from the taggants can be seen at the same time by using an IR light source such as a Class III laser (950 nm) and a long wave UV light (365 nm) source to excite both taggants in the fiber. The taggants then emit visible light to allow the fiber to be authenticated.

Should the choice be made to include up conversion or down conversion materials that do not emit into the visible spectrum, then additional equipment is necessary to confirm the presence of the taggant. This type equipment can be solid state electronic sensors housed in casings and built specifically for the detection of certain taggants. It is possible to use one taggant that emits in the visible spectrum, while using another that emits in the invisible portions of the spectrum. Both taggants could also emit in the invisible part of the spectrum.

In general, the components are arranged in substantially constantly positioned distinct zones across the cross section of the multicomponent fiber and extend continuously along the length of the multicomponent fiber. A preferred configuration is sheath-core fiber 10, wherein sheath 11 substantially surrounds a second component, core 12. However, other structured fiber configurations as known in the art may potentially be used, such as but not limited to, "islands-in-the-sea" arrangements and the like. Islands-in-the-sea, in practice, can represent fibers with as few as two (2) cores or islands and as many as several hundred cores or islands. Most typical are fibers with from three to thirty-six (3-36) cores or islands which need not be all the same size nor shape.

Figure 7:
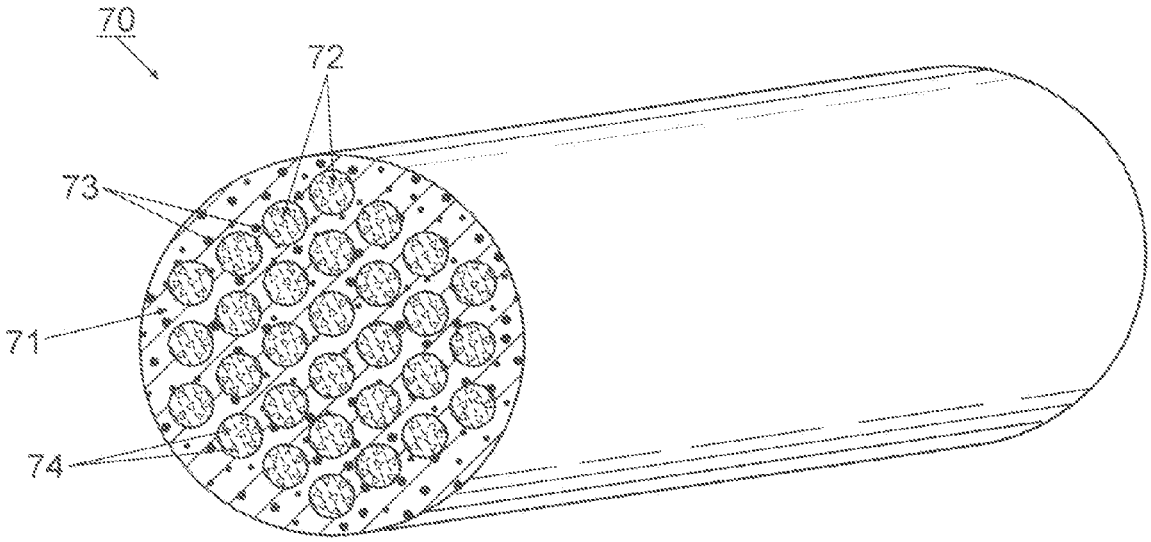
FIG. 7 shows another fiber embodiment having a sheath zone with multiple core zones.

FIG. 7 shows fiber 70 which includes island or sheath 71 with thirty (30) cores 72 contained therein. Sheath 71 includes taggant 73 which may be for example a fluorescent dye, whereas each core 72 includes taggant 74 which may be for example $CaF_2$. As would be understood more or less cores 72 could be utilized when forming fiber 70.

The cross section of the multicomponent fiber is preferably circular, since the equipment typically used in the production of multicomponent synthetic fibers normally produces fibers with a substantially circular cross section. The configuration of the first and second components in a fiber of circular cross section can be either concentric or acentric, the latter configuration sometimes being known as a "modified side-by-side" or an "eccentric" multicomponent fiber.

The concentric configuration is characterized by the first component having a substantially uniform thickness, such that the second component lies approximately in the center of the fiber. In the acentric configuration, the thickness of the first component varies, and the second component therefore does not lie in the center of the fiber. In either case, the second component is substantially surrounded by the first component. Both the cross section of the fiber and the configuration of the components will depend upon the equipment which is used in the preparation of the fiber, the process conditions and the melt viscosities of the two components.

The fibers can optionally include other components not adversely affecting the desired properties thereof. Examples include, without limitation, antioxidants, stabilizers, particulates, pigments, and the like. These and other additives can be used in conventional amounts.

The polymer resin forming the nanocomposite matrix can be any of the types of polymer resins known in the art capable of being formed into a fiber construction. Examples of suitable polymers useful in the practice of the present invention include without limitation polyolefins, including polypropylene, polyethylene, polybutene, polymethyl pentene (PMP), polyamides, including nylon 6, nylon 6,6, polyesters, including polyethylene terephthalate (PET), polyethylene naphthalate, polytrimethylene terephthalate, poly (1,4-cyclohexylene dimethylene terephthalate) (PCT), and aliphatic polyesters such as polylactic acid (PLA), polyphenylene sulfide, thermoplastic elastomers, polyacrylonitrile, acetals, fluoropolymers, co- and ter-polymers thereof and mixtures thereof. PLA is among the "preferred embodiment" polymers.

As noted above, the fibers of the invention can also include other conventional polymers, but without the exfoliated platelet particles. The fibers can optionally include other components not adversely affecting the desired properties thereof such as antioxidants, stabilizers, particulates, pigments, and the like. These and other additives can be used in conventional amounts.

The present invention will be further illustrated by the following non-limiting example:

EXAMPLE 1

Continuous multi-filament melt spun fiber is produced using a bicomponent extrusion system.

The sheath component of the bicomponent fiber consists of polyethylene terephthalate with an inherent viscosity of 0.64, blended with finely-divided particles of a suitable fluorophore at a loading of between 0.1 and 3.0 percent by weight.

The core component consists of polyethylene terephthalate with an inherent viscosity of 0.64, blended with finely-divided particles of yttrium oxide at a loading of between 0.1 and 3.0 percent by weight.

The weight ratio of sheath to core is 50/50. The two components are subjected to sheath-and-core type conventional bicomponent melt spinning. The filaments are subsequently drawn, thereby yielding a three (3) denier multifilament fiber.

The illustrations and examples provided herein are for explanatory purposes and are not intended to limit the scope of the appended claims.

We claim:

1. A multicomponent taggant fiber comprising:

a. a first zone, said first zone comprising a first polymer, a first taggant, said first taggant within said first polymer;

b. a second zone, said second zone separate from said first zone and comprising a second polymer, a second taggant, said second taggant within said second polymer, said first taggant being chemically incompatible upon contact with said second taggant.

2. The multicomponent taggant fiber as claimed in claim 1 wherein said first zone is concentric to said second zone.

3. The multicomponent taggant fiber as claimed in claim 1 wherein said first zone is acentric to said second zone.

4. The multicomponent taggant fiber as claimed in claim 1 wherein said multicomponent taggant fiber is cylindrically shaped.

5. The multicomponent taggant fiber as claimed in claim 1 wherein said multicomponent taggant fiber is multi-lobal.

6. The multicomponent taggant fiber as claimed in claim 5 wherein said multi-lobal fiber comprises a tri-lobal fiber.

7. The multicomponent taggant fiber as claimed in claim 1 wherein said first polymer comprises polyethylene terephthalate.

8. The multicomponent taggant fiber as claimed in claim 1 wherein said first polymer is selected from the group comprising: polyolefins, including polypropylene, polyethylene, polybutene, polymethyl pentene (PMP), polyamides, including nylon 6, nylon 6,6, polyesters, including polyethylene terephthalate (PET), polyethylene naphthalate, polytrimethylene terephthalate, poly (1,4-cyclohexylene dimethylene terephthalate) (PCT), aliphatic polyesters including polylactic acid (PLA), polyphenylene sulfide, thermoplastic elastomers, polyacrylonitrile, acetals, fluoropolymers, co- and ter-polymers and mixtures thereof.

9. The multicomponent taggant fiber as claimed in claim 1 wherein said second polymer comprises polyethylene terephthalate.

10. The multicomponent taggant fiber as claimed in claim 1 wherein said second polymer is selected from the group comprising: polyolefins, including polypropylene, polyethylene, polybutene, polymethyl pentene (PMP), polyamides, including nylon 6, nylon 6,6, polyesters, including polyethylene terephthalate (PET), polyethylene naphthalate, polytrimethylene terephthalate, poly (1,4-cyclohexylene dimethylene terephthalate) (PCT), aliphatic polyesters including polylactic acid (PLA), polyphenylene sulfide, thermoplastic elastomers, polyacrylonitrile, acetals, fluoropolymers, co- and ter-polymers and mixtures thereof.

11. The multicomponent taggant fiber as claimed in claim 1 wherein said first taggant comprises an organic material, and said second taggant comprises an inorganic material.

12. The multicomponent taggant fiber as claimed in claim 1 wherein said first taggant comprises a fluorophore, and said second taggant comprises yttrium oxide.

13. The multicomponent taggant fiber as claimed in claim 1 wherein said first taggant comprises an organic material selected from the group including: fluorophores such as phytochrome, riboflavin and naturally occurring fluorescent minerals.

14. The multicomponent taggant fiber as claimed in claim 1 wherein said second taggant comprises an inorganic material selected from the group including: oxides, sulfides, selenides, halides or silicates of zinc, cadmium, manganese, aluminum, silicon, or various rare earth metals.

15. A multicomponent taggant fiber comprising:

a. a first zone, said first zone comprising a first polymer, a first optically active taggant, said first optically active taggant within said first polymer;

b. a second zone, said second zone separate from said first zone and comprising a second polymer, a second optically active taggant, said second optically active taggant within said second polymer, a first stimulus, said first optically active taggant responsive to said first stimulus, and a second stimulus, said second optically active taggant responsive to said second stimulus.

16. The multicomponent taggant fiber as claimed in claim 15 wherein said first taggant and said second taggant are different.

17. The multicomponent taggant fiber as claimed in claim 15 wherein said first stimulus is different from said second stimulus.

18. The multicomponent taggant fiber as claimed in claim 15 wherein said first optically active taggant provides a different wave length emission from said second optically active taggant when said first and said second taggants are stimulated.

19. The multicomponent taggant fiber as claimed in claim 15 wherein said first taggant and said second taggant each absorb and emit light in the 200-1200 nm range.

20. The multicomponent taggant fiber as claimed in claim 15 wherein said first taggant and said second taggant each emit visible light when stimulated.

21. The multicomponent taggant fiber as claimed in claim 15 wherein said first taggant is only responsive to said first stimulus and said second taggant is only responsive to said second stimulus.

22. The multicomponent taggant fiber as claimed in claim 15 wherein said first taggant and said second taggant are invisible in ambient light.

23. The multicomponent taggant fiber as claimed in claim 15 wherein said first taggant and said second taggant are white in ambient light.

24. A multicomponent taggant fiber comprising:

a. a first zone, said first zone comprising a first polymer, a first optically active taggant, said first optically active taggant within said first polymer, said first optically active taggant comprising a fluorophore;

b. a second zone, said second zone separate from said first zone and comprising a second polymer, a second optically active taggant, said second optically active taggant within said second polymer, said second optically active taggant comprises yttrium oxide a first stimulus, said first optically active taggant responsive to said first stimulus, and a second stimulus, said second optically active taggant responsive to said second stimulus.

* * * * *